US011493299B2

(12) United States Patent
Jacobson et al.

(10) Patent No.: US 11,493,299 B2
(45) Date of Patent: Nov. 8, 2022

(54) FIREARM VISE AND SUPPORT DEVICE

(71) Applicant: New Revo Brand Group, LLC, Plymouth, MN (US)

(72) Inventors: Ryan Jacobson, Minneapolis, MN (US); Ryan Chernik, New Brighton, MN (US); Matthew C. Morris, Minneapolis, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 8 days.

(21) Appl. No.: 16/989,878

(22) Filed: Aug. 10, 2020

(65) Prior Publication Data

US 2020/0370853 A1 Nov. 26, 2020

Related U.S. Application Data

(63) Continuation-in-part of application No. 16/545,779, filed on Aug. 20, 2019, now Pat. No. 10,739,101.
(Continued)

(51) Int. Cl.
*F41A 23/18* (2006.01)
*F41A 11/00* (2006.01)

(52) U.S. Cl.
CPC ..... *F41A 23/18* (2013.01); *F41A 11/00* (2013.01)

(58) Field of Classification Search
CPC ..... F41A 35/00; F41A 31/02; F41A 31/00; F41A 23/18; F41A 11/00; B25B 1/2463
(Continued)

(56) References Cited

U.S. PATENT DOCUMENTS 2,907,238 A * 10/1959 White ..... B25B 1/2484 269/252
2,948,172 A 8/1960 Gustav et al.
(Continued)

FOREIGN PATENT DOCUMENTS

CN 103056790 A 4/2013
CN 203956763 U * 11/2014
(Continued)

OTHER PUBLICATIONS

U.S. Appl. No. 13/562,651.
(Continued)

*Primary Examiner* — John Cooper
(74) *Attorney, Agent, or Firm* — Grumbles Law PLLC; Brittany Nanzig

(57) ABSTRACT

A firearm maintenance aid can include a firearm vise and a firearm support device. Firearm vise can include vise jaws, a threaded rod connecting vise jaws together, and jaw pin holes in each jaw, the holes extending from an outer surface of a jaw through to an inner surface of each jaw, wherein the holes in the first jaw align with the holes in the second jaw. Firearm support device can include a clamping portion and a supporting portion. The clamping portion can be clamped between the jaws of the firearm vise, can include two parallel clamping faces, and can define vise pin holes that align with the jaw pin holes. The supporting portion can be located opposite the clamping portion and can include a cylindrical shaft. Vise pins can be received by the jaw pin holes and vise pin holes to fixedly connect the support device to the vise.

20 Claims, 10 Drawing Sheets

Related U.S. Application Data

(60) Provisional application No. 62/724,279, filed on Aug. 29, 2018.

(58) Field of Classification Search
USPC ..... 42/94
See application file for complete search history.

(56) References Cited

U.S. PATENT DOCUMENTS

| | | | | |
|---|---|---|---|---|
| 3,322,423 | A | 5/1967 | Popow et al. | |
| 3,463,479 | A * | 8/1969 | Hennessey | B23Q 3/103 33/549 |
| 3,718,327 | A | 2/1973 | Nunez | |
| 3,783,548 | A | 1/1974 | Fisher | |
| 4,184,667 | A | 1/1980 | Alessio | |
| 4,252,305 | A | 2/1981 | Pasch | |
| 4,437,654 | A | 3/1984 | Chiappetti | |
| 4,807,861 | A | 2/1989 | Kimball | |
| 4,861,010 | A | 8/1989 | Neil | |
| 4,971,301 | A | 11/1990 | Yang | |
| 5,092,572 | A | 3/1992 | Litwak et al. | |
| 5,224,692 | A | 7/1993 | Anderson et al. | |
| 5,236,183 | A | 8/1993 | Curtis | |
| 5,243,883 | A | 9/1993 | Savage | |
| 5,419,540 | A * | 5/1995 | Teafatiller | B25B 1/2463 269/283 |
| 5,690,416 | A | 11/1997 | Van Gennep | |
| 5,921,536 | A | 7/1999 | Bernstein | |
| 6,105,948 | A * | 8/2000 | Young | B25B 1/2478 269/244 |
| 6,170,813 | B1 | 1/2001 | Bowers | |
| 6,293,041 | B2 | 9/2001 | Weaver | |
| 6,640,666 | B2 | 11/2003 | Pliley | |
| 6,672,578 | B1 * | 1/2004 | Martens | B25B 1/2468 269/282 |
| 6,971,643 | B1 | 12/2005 | Garrison | |
| 7,017,898 | B2 | 3/2006 | Varzino et al. | |
| 7,055,813 | B2 | 6/2006 | Hexamer, Jr. | |
| 7,111,836 | B1 | 9/2006 | West | |
| 7,201,541 | B2 | 4/2007 | Barmann | |
| 7,290,760 | B1 | 11/2007 | Lindsay | |
| 7,356,960 | B1 | 4/2008 | Knitt | |
| 7,584,690 | B2 | 9/2009 | Cauley | |
| 7,690,606 | B1 | 4/2010 | Batdorf | |
| 7,886,474 | B2 | 2/2011 | Werner | |
| 7,946,071 | B2 | 5/2011 | Cauley | |
| 7,980,017 | B2 | 7/2011 | Harman, III | |
| 8,167,292 | B1 | 5/2012 | Mucciacciaro et al. | |
| 8,296,988 | B2 | 10/2012 | Yale et al. | |
| 8,297,605 | B2 | 10/2012 | Lee et al. | |
| 8,308,392 | B2 | 11/2012 | Yu et al. | |
| 8,316,571 | B1 | 11/2012 | Holland | |
| 8,322,068 | B2 | 12/2012 | Wilson | |
| 8,322,699 | B2 | 12/2012 | Prell et al. | |
| 8,342,495 | B2 | 1/2013 | Weissenborn | |
| 8,382,048 | B2 | 2/2013 | Nesper et al. | |
| 8,578,645 | B2 | 11/2013 | Cauley | |
| 8,707,609 | B2 | 4/2014 | Fisher | |
| 8,931,201 | B2 | 1/2015 | Gianladis et al. | |
| 9,121,423 | B2 | 9/2015 | Sharpe et al. | |
| 9,372,041 | B1 * | 6/2016 | Geissele | F41A 35/00 |
| 9,421,672 | B2 | 8/2016 | Rowlay et al. | |
| D768,254 | S * | 10/2016 | Geissele | D22/108 |
| 9,506,711 | B2 * | 11/2016 | Gomez | F41A 21/48 |
| 9,583,083 | B1 | 2/2017 | Berlinger | |
| 9,616,552 | B1 | 4/2017 | McClain | |
| 9,733,036 | B2 | 8/2017 | Tucker et al. | |
| 9,737,064 | B2 | 8/2017 | Durrant | |
| 9,816,546 | B2 * | 11/2017 | Gomez | F16B 37/00 |
| 9,823,035 | B2 | 11/2017 | Geissele et al. | |
| 9,933,226 | B2 | 4/2018 | Tucker et al. | |
| 9,976,693 | B1 | 5/2018 | Delikat et al. | |
| 10,024,621 | B2 | 7/2018 | Hutson | |
| 10,040,172 | B2 | 8/2018 | Weissenborn | |
| 10,178,209 | B1 | 1/2019 | Hesse | |
| D844,093 | S * | 3/2019 | Shelton | D22/199 |
| 10,384,331 | B2 | 8/2019 | Maggert | |
| D870,840 | S * | 12/2019 | Cheng | D22/108 |
| 2002/0171191 | A1 | 11/2002 | Hudson | |
| 2004/0195479 | A1 | 10/2004 | Gulley | |
| 2005/0188578 | A1 * | 9/2005 | Engel | F41A 3/18 42/16 |
| 2009/0229160 | A1 | 9/2009 | Elliott et al. | |
| 2009/0273132 | A1 * | 11/2009 | Parks | B25B 1/2468 269/280 |
| 2009/0278296 | A1 | 11/2009 | Fulcher et al. | |
| 2012/0227305 | A1 | 9/2012 | Fontenot et al. | |
| 2012/0255212 | A1 | 10/2012 | Werner | |
| 2014/0075817 | A1 | 3/2014 | Gomez | |
| 2015/0014911 | A1 | 1/2015 | Melanson | |
| 2015/0115114 | A1 | 4/2015 | White | |
| 2016/0202008 | A1 * | 7/2016 | Geissele | F41A 11/00 42/108 |
| 2016/0339562 | A1 | 11/2016 | Myers | |
| 2017/0108303 | A1 * | 4/2017 | Gomez | F41A 5/26 |
| 2018/0117738 | A1 | 5/2018 | Klumper | |
| 2020/0180115 | A1 | 6/2020 | Yang | |

FOREIGN PATENT DOCUMENTS

| | | | | |
|---|---|---|---|---|
| CN | 206316953 | U * | 7/2017 | |
| DE | 2131378 | A | 12/1972 | |
| DE | 8612639 | U1 | 6/1987 | |
| DE | 102013004952 | A1 | 3/2014 | |
| DE | 202014006697 | U1 | 10/2014 | |
| EA | 027332 | B1 | 7/2017 | |
| EP | 201817 | A * | 11/1986 | B25B 1/22 |
| EP | 0201817 | A2 | 11/1986 | |
| GB | 415518 | A | 8/1934 | |
| GB | 662672 | A | 12/1951 | |
| GB | 707546 | A | 4/1954 | |
| GB | 2345656 | A | 3/1999 | |
| GB | 2426948 | B | 12/2006 | |
| WO | WO01986001267 | A1 | 2/1986 | |

OTHER PUBLICATIONS

Multi-Angle Base Vise. Website. Retrieved Jan. 2020. https://www.stanleytools.com/products/hand-tools/manual-fastener-tools/spring-metal-angle/multiangle-base-vise/83-069m.

Stanley Maxsteel Multi Angle Vice. Website. Retrieved Jan. 2020. https://www.youtube.com/watch?v=jSE2gOqQIvE.

Wilton Junior 343 Pow-R-Arm. Retrieved Jan. 2020. https://www.northerntool.com/shop/tools/product_200711704_2007.

Monsterballvise. Retrieved Jan. 2020. https://www.monsterballvise.com/index.htm.

Hyskore Cleaning & Sighting Vise. Retrieved Jan. 2020. https://www.amazon.com/HYSKORE-1003627-Hyskore-Cleaning-Sighting.

Lyman Revolution Gun Vise. Retrieved Jan. 2020. https://www.midwayusa.com/product.

CB01 C-Clamp + High Weight Load Inner Ball Magic Grip. Retrieved Jul. 2020. https://www.digitalfoto.cn/cb01-c-clamp-high-weight-load-inner-ball-magic-grip.

Kurt Workholding. Retrieved Jul. 2020. https://www.kurtworkholding.com/product/kurt-3-in-one-system-jaw-plates/.

2pcs Vise Jaws,5.5' Multi-Groove Magnetic Soft Bench Vise Vice Jaw Pad Accessories. Retrieved Jul. 2020. https://www.amazon.com/2pcs-Multi-Groove-Magnetic-Bench-Accessories.

VJ-6A060201MR—Machine Reversible Aluminium Vise Soft Jaws for a 6' Vise . . . Retrieved Jul. 2020. https://www.amazon.com/VJ-6A060201MR-MACHINE-REVERSIBLE-ALUMINIUM-VISE.

Model:346NM Deluxe Non-Marking Neoprene Jaw Pads. Retrieved Jul. 2020. https://www.panavise.com/index.html.

Ultimate Versatile Vise. Retrieved Jul. 2020. https://www.garrettwade.com/ultimate-versatile-vise.html.

Tipton Gun Vise. Retrieved Jul. 2020. https://www.midwayusa.com/product/101491760.

(56) References Cited

OTHER PUBLICATIONS

3-Axis Precision Tilting Vise 3" Jaw Width. Retrieved Jul. 2020. https://www.wiltontools.com/us/en.
Mission Automotive Store, Vise Soft Jaws / Vice Jaw Pads—Magnetic—4.5 Inch Length, Multi-Groove Design, Durable TPU Rubber Covers—Fit Wide Array of Vises / Vices and Blocks (4 5 6 In)—By Mission Automotive, https://www.amazon.com/Vise-Soft-Jaws-Vice-Pads/dp/B01FT2QTDA, accessed Feb. 10, 2022.
OTIS Technology, Soft Vise Jaws, https://otistec.com/otis-soft-vise-jaws/, accessed Feb. 10, 2022.

* cited by examiner

FIG. 8
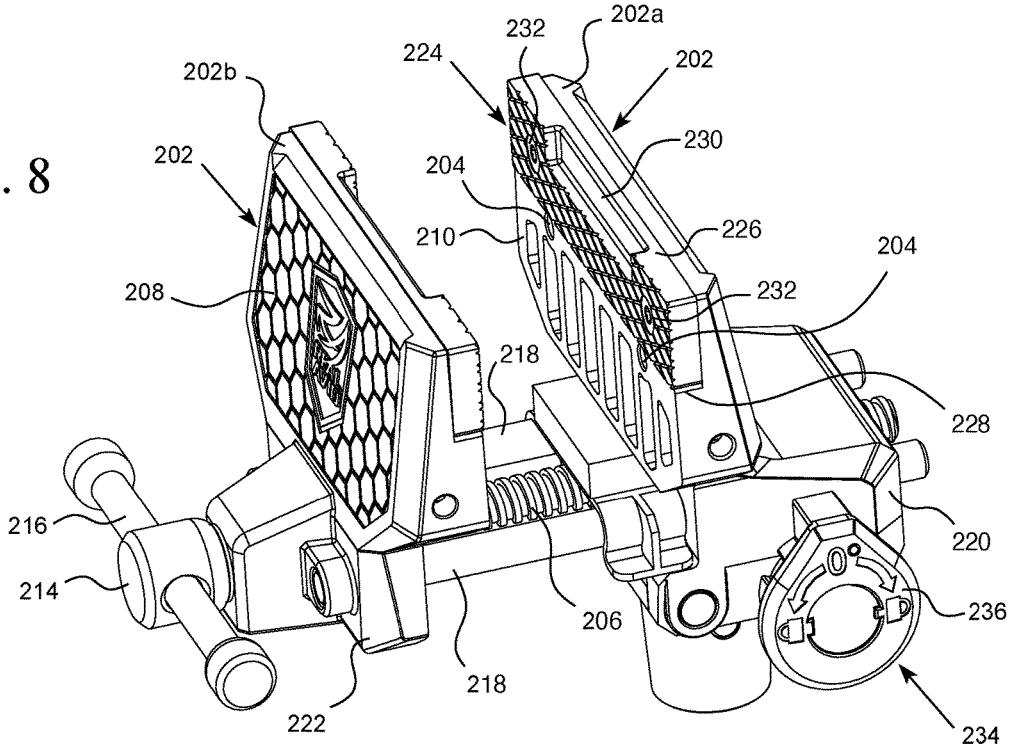
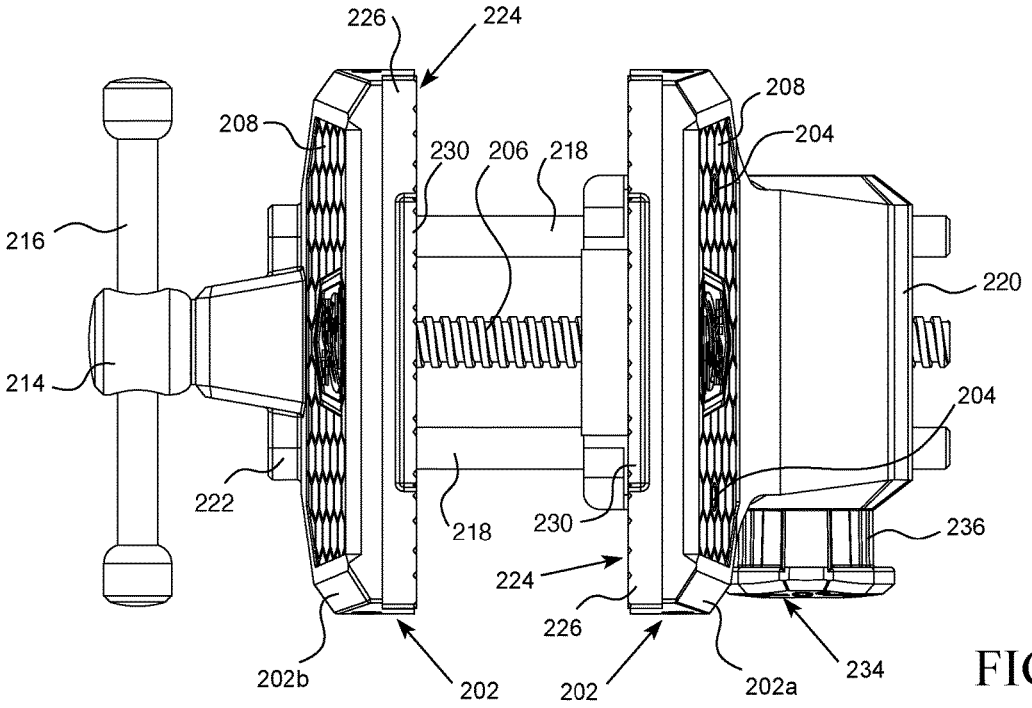
FIG. 9

FIREARM VISE AND SUPPORT DEVICE

CROSS-REFERENCE TO RELATED APPLICATION

This application is a continuation-in-part of U.S. Non-Provisional application Ser. No., filed Aug. 20, 2019 and titled FIREARM SUPPORT DEVICE, which claims the benefit of U.S. Provisional Patent Application Ser. No. 62/724,279, filed Aug. 29, 2018 and titled FIREARM SUPPORT DEVICE, which is herein incorporated by reference in its entirety.

FIELD OF THE INVENTION

This disclosure relates to firearm maintenance aids, and more particularly, relates to vises and vise support devices for firearm maintenance.

BACKGROUND OF THE INVENTION

During maintenance activities, firearms such as rifles (or sub-components thereof) are often held or otherwise supported by clamps, jigs, vises, or other mechanical support arrangements. This can free up an armorer's hands for performing maintenance tasks and can enable greater application of torque to firearm components than, for example, handholding. In some cases, however, an armorer can clamp a firearm component into a vise in such a way that the component may be damaged. It is desirable to provide vise support devices for firearm maintenance that can provide secure support for firearm components with minimal or no risk of damaging said components as a result of clamping. It is further desirable to provide a vise designed to work in coordination with such a vise support device to prevent unwanted movement of the vise support device when it is secured in the vise.

SUMMARY OF THE INVENTION

This disclosure relates to firearm maintenance aids, and more particularly, relates to vises and vise support devices for firearm maintenance. In an illustrative but non-limiting example, the disclosure provides a firearm maintenance aid that can include a firearm vise, a firearm support device having an elongate member, and at least two vise pins. The a firearm vise can include first and second jaws, a threaded rod connecting first and second jaws, and at least two jaw pin holes in each jaw, wherein each of the at least two jaw pin holes in the first jaw can align with each of the at least two jaw pin holes in the second jaw, and wherein the at least two jaw pin holes of at least one of the first or second jaw can extend from an outer surface through to an inner surface of the at least one of the first or second jaw. The elongate member can include a clamping portion structured and configured to be clamped between the first and second jaws of the firearm vise, the clamping portion including two parallel clamping faces on opposite sides of the clamping portion, the clamping portion defining a plurality of vise pin holes, and a supporting portion opposite the clamping portion, the supporting portion including a generally cylindrical shaft, wherein the at least two jaw pin holes in each jaw can align with at least two of the plurality of vise pin holes. The at least two vise pins can be configured to connect the first jaw, the elongate member, and the second jaw together by concurrently penetrating through the aligned at least two jaw pin holes of the first jaw, at least two vise pin holes of the clamping portion, and at least two jaw pin holes of the second jaw.

In some examples, the at least two vise pins can be structured and configured to be received by any of the plurality of vise pin holes of the clamping portion. In addition, or alternatively, the at least two vise pins can be structured and configured to be received by any of the at least two jaw pin holes of the first and second jaws.

In some examples, the firearm support device can further include a stop portion located between and structurally connecting the clamping portion and the supporting portion, the stop portion including a generally-planar upper receiver stop face that faces the supporting portion and is perpendicular to a long axis of the elongate member. The supporting portion may be structured and configured to provide support to an upper receiver of a firearm, and the upper receiver stop face may be configured to prevent translation of the upper receiver toward the clamping portion of the device when a back side of the upper receiver bears against the upper receiver stop face. Further, the firearm support device can have a lock knob having a boss, wherein the supporting portion can define a plurality of lock knob holes structured and configured to receive the boss, the lock knob holes being aligned radially and located circumferentially around the generally cylindrical shaft, and the lock knob holes can be located at substantially identical distances from the upper receiver stop face, such that when the back side of the upper receiver bears against the upper receiver stop face, and when the boss of the lock knob projects through an opening on an underside of the upper receiver and is received by one of the lock knob holes, the lock knob can be positioned to prevent translation of the upper receiver away from the clamping portion of the device.

In some examples, the firearm support device can include a lock knob, the lock knob including a boss structured and configured to be received by any of a plurality of lock knob holes located around the shaft of the supporting portion, wherein the supporting portion of the elongate member can includes a barrel end and is structured and configured to provide support to an upper receiver of a firearm, the supporting portion can further define the plurality of lock knob holes aligned radially and located circumferentially around the generally cylindrical shaft, and the lock knob holes can be located at substantially identical distances from the barrel end of the supporting portion, such that when the boss of the lock knob projects through an opening on an underside of the upper receiver and is received by one of the lock knob holes, the lock knob is positioned to prevent translation of the upper receiver toward the barrel end of the device. The firearm support device may further include a stop portion located between and structurally connecting the clamping portion and the supporting portion, the stop portion including a generally-planar upper receiver stop face that faces the supporting portion and is perpendicular to a long axis of the elongate member, the upper receiver stop face configured to prevent translation of the upper receiver toward the clamping portion of the device when a back side of the upper receiver bears against the upper receiver stop face.

In some examples, the clamping portion is located at a first end of the elongate member, the supporting portion is located at a second end of the elongate member, and the supporting portion of the firearm support device is aligned with a long axis of the elongate member. And in some cases, the supporting portion further includes, at a barrel end of the supporting portion, a plurality of splines structured and configured to mate with lugs of a barrel extension of a barrel of the firearm.

In another illustrative but non-limiting example, the disclosure provides a method of assembling a firearm maintenance aid, the method comprising placing a firearm support device having a clamping portion between first and second jaws of a firearm vise; aligning at least two of the plurality of vise pin holes with at least two of the plurality of jaw pin holes from each jaw; clamping the firearm support device between the first and second jaws of the firearm vise; inserting a vise pin into one of the jaw pin holes of the at least one of the first or second jaws having the jaw pin holes extend from the outer surface through to the inner surface; inserting the vise pin through one of the vise pin holes of the elongate member; and inserting the vise pin into the inner surface of one of the jaw pin holes of the other of the first or second jaws. The clamping portion can include two parallel clamping faces on opposite sides of the clamping portion and defining a plurality of vise pin holes, and the first and second jaws can each define a plurality of jaw pin holes, wherein the jaw pin holes extend from an outer surface of at least one of the first or second jaws through to an inner surface of the at least one of the first or second jaws.

In some examples, the method can further include inserting a second vise pin into a second of the jaw pin holes of the at least one of the first or second jaws having the jaw pin holes extend from the outer surface through to the inner surface; inserting the second vise pin through a second of the vise pin holes of the elongate member; and inserting the second vise pin into the inner surface of a second of the jaw pin holes of the other of the first or second jaws.

In some examples, the method can further include inserting a barrel end of a supporting portion of the firearm support device into an upper receiver of a firearm, wherein an elongate member is comprised of the clamping portion and the supporting portion, the supporting portion includes a generally cylindrical shaft and is located opposite the clamping portion, a stop portion is located between and structurally connects the clamping portion and the supporting portion, the stop portion includes a generally-planar upper receiver stop face that is perpendicular to a long axis of the elongate member, and the upper receiver stop face is configured to prevent translation of the upper receiver toward the clamping portion when a back side of the upper receiver bears against the upper receiver stop face.

In another illustrative but non-limiting example, the disclosure provides a firearm maintenance aid, the firearm maintenance aid having a firearm vise, a firearm support device, and at least two vise pins. The firearm vise can have a first jaw, a second jaw moveable relative to the first jaw, a threaded rod connecting the first jaw and the second jaw, wherein the second jaw is moveable along the threaded rod toward and away from the first jaw, and a plurality of jaw pin holes in each of the first and second jaws, wherein at least two of the plurality of jaw pin holes in the first jaw align with at least two of the plurality of jaw pin holes in the second jaw, and wherein the jaw pin holes extending from an outer surface of at least one jaw through to an inner surface of the at least one jaw. The firearm support device can have a clamping portion structured and configured to be clamped between the first and second jaws of the firearm vise, the clamping portion including two parallel clamping faces on opposite sides of the clamping portion, and the clamping portion defining a plurality of vise pin holes, wherein the aligned, at least two jaw pin holes in each jaw further align with at least two of the plurality of vise pin holes. The at least two vise pins can connect the first jaw, the elongate member, and the second jaw together, wherein each of the at least two vise pins penetrate through one of the at least two jaw pin holes from the outer surface to the inner surface, through one of the at least two vise pin holes, and into one of the at least two jaw pin holes of the inner surface of the other of the first or second jaw.

In one example, the firearm vise can also include a handle connected to a screw head on one end of the threaded rod, and a plurality of guide bars parallel to, and on opposite sides of, the threaded rod, the plurality of guide bars connecting to the first and second jaws. In another example, the firearm vise can include a reversible jaw insert for at least one of the first and second jaws, the reversible jaw insert including top and bottom long edges, wherein the reversible jaw insert includes a recess along either or both of the top and bottom long edges, and the reversible jaw insert attaches to the inner surface of at least one of the first or second jaws.

In one example, the firearm vise can have a clamp base attached to the first jaw and a jaw base attached to the second jaw, wherein the clamp base and the jaw base each include a threaded cavity for receiving the threaded rod. Further, the firearm vise can have a vise base having a housing and connected to the clamp base via a ball joint, wherein the ball joint includes a ball located within the housing, a stem connected on a first end to the ball and on a second end to the clamp base, and a ball locking mechanism for securing the ball in a predetermined position within the housing. Further, the vise base can include a cam latch for securing the ball in a second predetermined position. In some cases, the firearm vise can have a vise base having a table mount for securing the firearm vise to a flat surface.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which:

FIG. 8 is a schematic perspective view of an illustrative example of a portion of a firearm vise;

FIG. 9 is a schematic plan view of the firearm vise of FIG. 8;

DETAILED DESCRIPTION

Figure 1:
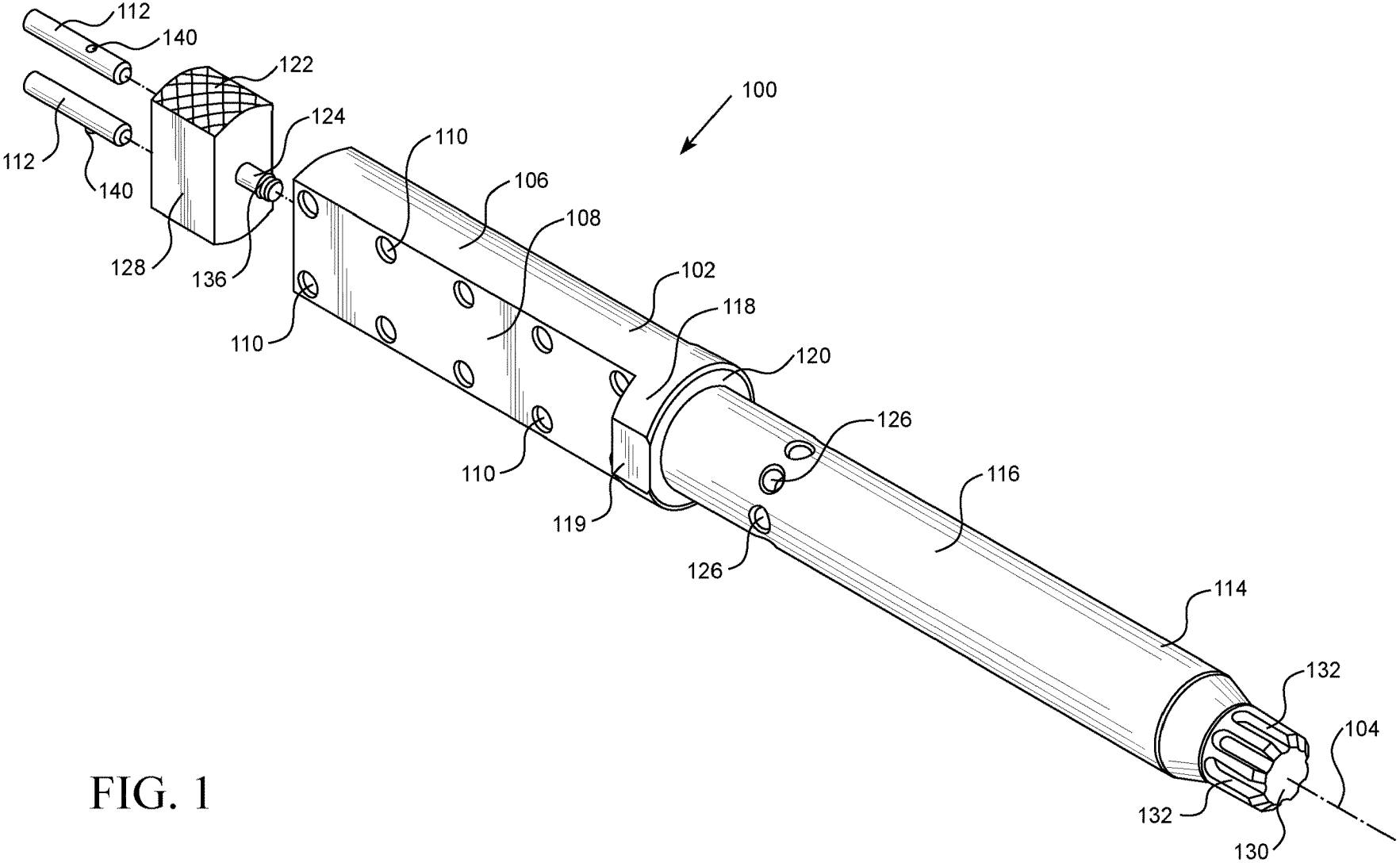
FIG. 1 is a schematic perspective view of an illustrative example of a firearm support device.

The present disclosure relates to firearm maintenance aids, and more particularly, relates to vises and vise support devices for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

As mentioned above, the present disclosure relates to support devices for firearms, including AR-15 type rifles. U.S. Pat. No. 9,372,041 provides a general description of a firearm that may be an AR-15 type rifle in FIGS. 1, 2, and 3, and from column 2, line 47 to column 5, line 32. These portions of U.S. Pat. No. 9,372,041 are hereby incorporated by reference into the present disclosure, to the extent that they do not contradict any portion of the instant disclosure.

Various known firearm maintenance support devices demonstrate shortcomings that limit their usefulness. Some known devices involve clamping the upper receiver of a rifle such as an AR-15, which can subject the upper receiver to forces that it is not intended or designed to bear, potentially resulting in damage to the component. Other devices exist, such as that described in U.S. Pat. No. 9,372,041, that themselves are clamped into a vise, and the firearm components are mounted to the device. Some of these devices only provide for supporting the firearm components in very specific or limited orientations, and some such devices only include minimal features to accommodate clamping by a vise. The present disclosure provides firearm support devices that can robustly and flexibly support firearm components in various orientations according to a user's preference, and that provide accessories that assist in vise clamping of the device. It further provides disclosure of vises that can work in coordination with such support devices to prevent unwanted movement of the support device, and therefore the firearm, when the support device is secured in the vise. The firearm support device and firearm vise together are a firearm maintenance aid that can be used to help a user securely and efficiently clean, maintain, assemble, and disassemble a firearm.

Figure 2:
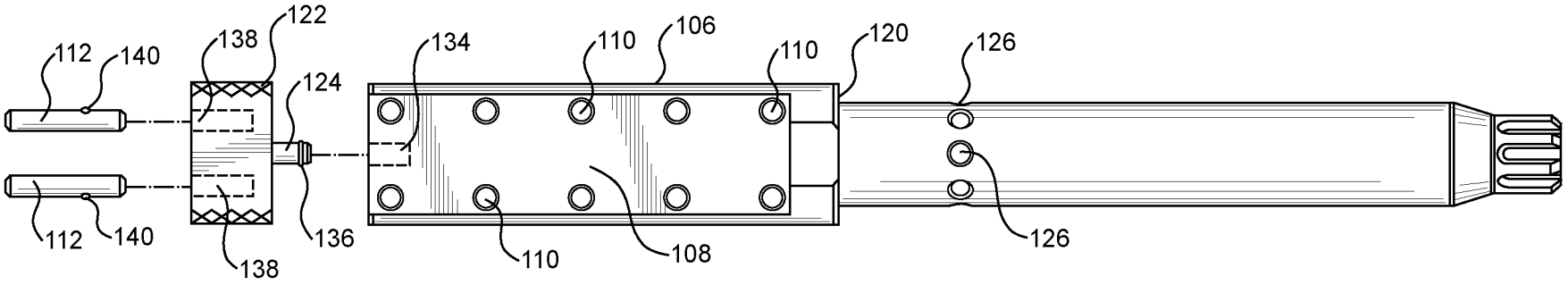
FIG. 2 is a schematic plan view of the firearm support device of FIG. 1.
Figure 3:
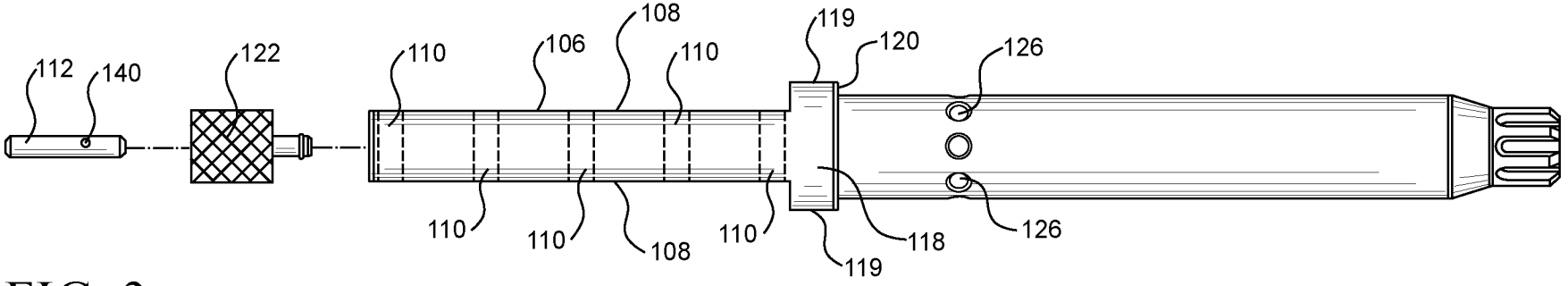
FIG. 3 is a schematic side view of the firearm support device of FIG. 1.

FIG. 1 is a schematic perspective view of an illustrative example of a firearm support device 100, which may be described as a vise block and/or a vise rod. FIG. 2 is a plan view of firearm support device 100, and FIG. 3 is a side view of the same. Device 100 can include an elongate member 102 having a long axis 104. Elongate member 102 can include a clamping portion 106 that can be structured and configured to be clamped between jaws of a bench vise. For example, clamping portion 106 can include two parallel clamping faces 108 on opposite sides of the clamping portion with curved sides between the clamping faces. The clamping portion also can define a plurality of vise pin holes 110. As indicated in FIG. 3 by phantom lines extending through clamping portion 106, pin holes 110 can be through-holes extending between opposing clamping faces 108, but this is not required in all examples, and in some embodiments, one or more vise pin holes can be blind holes.

Figure 4:
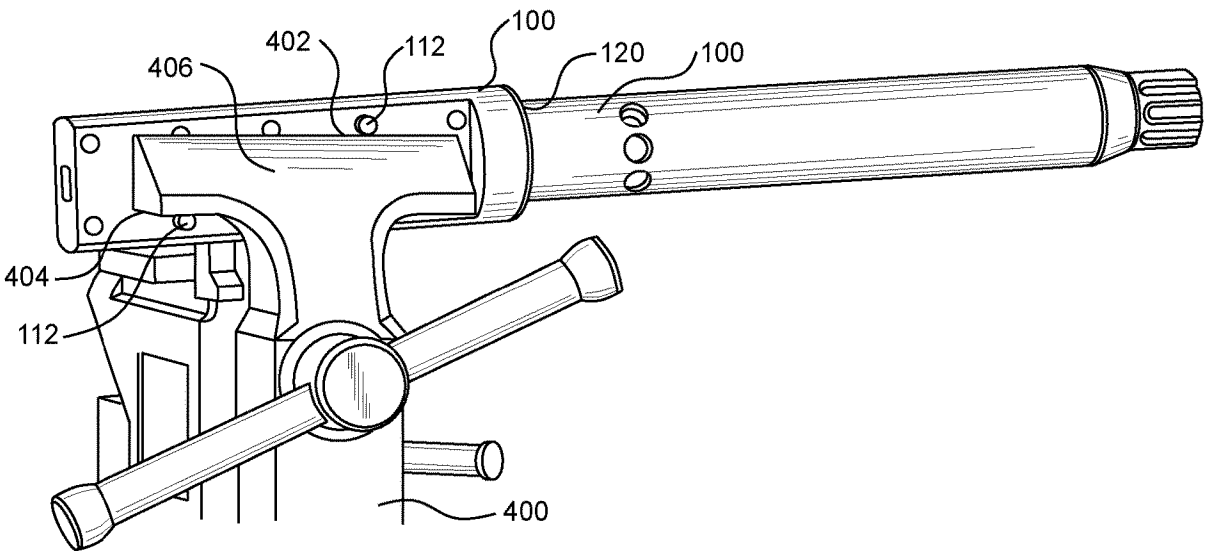
FIG. 4 is a schematic perspective view of the firearm support device of FIG. 1 clamped in a table vise.

Firearm support device 100 can include one or more vise pins 112 structured and configured to be received by any of the plurality of vise pin holes 110 of clamping portion 106, such that the vise pins are elongate and cylindrical in form and the vise pin holes are similarly shaped and dimensioned to enable a friction fit. More specifically, the external circumference of vise pins 112 may be substantially equivalent, albeit slightly smaller, to the internal circumference of vise pin holes 110. FIG. 4 is a schematic perspective illustration of firearm support device 100 clamped in a table vise 400. When received by suitable vise pin holes 110, the vise pins 112 can be positioned to bear against upper 402 and lower surfaces 404 of jaws 406 of a vise. So positioned, the vise pins 112 can serve to define and to assist in maintaining a working angle for firearm support device 100.

The elongate portion 102 of firearm support device 100 can include a supporting portion 114 structured and configured to provide support to an upper receiver of a firearm. Supporting portion 114 can include a generally cylindrical shaft 116 aligned with the long axis 104 of the elongate member 102 and in line with clamping portion 106, as illustrated in FIG. 1. Cylindrical shaft 116 can be shaped, structured, and configured such that an upper receiver of a rifle, which can be an AR-15 type rifle, can readily be slidingly engaged with the shaft via the rear opening of the upper receiver, and once the upper receiver is engaged with the cylindrical shaft, the shaft can provide robust support to the receiver.

Figure 5:
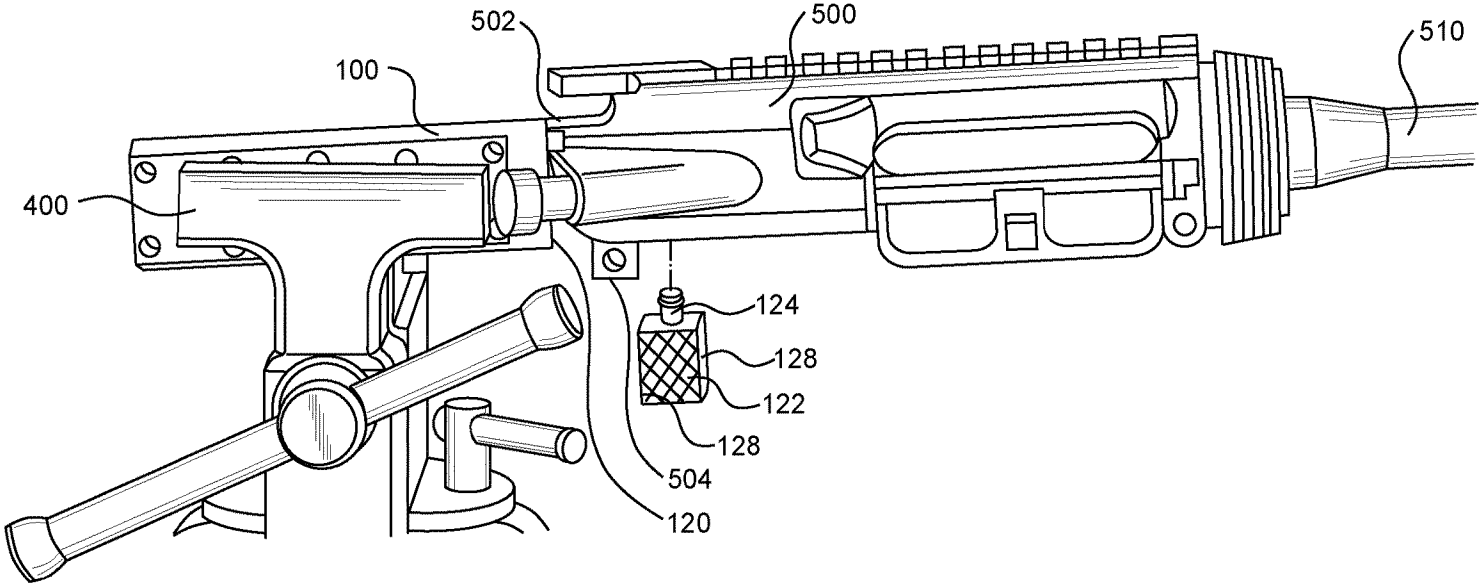
FIG. 5 is a schematic perspective view of the firearm support device of FIG. 1 clamped in a table vise, with an upper receiver engaged with the device.

Firearm support device 100 can include multiple features that can constrain and control the position of an upper receiver engaged with the device. FIG. 5 is a schematic perspective illustration of firearm support device 100 clamped in a table vise 400, with an upper receiver 500, which can be an AR-15 type upper receiver, engaged with supporting portion 114 of elongate portion 102 of the device. (In FIG. 5, upper receiver 500 is shown attached to a barrel 510 of the firearm, with only a portion of the barrel being shown in the drawing.)

Elongate portion 102 of firearm support device 100 can include a stop portion 118 located between and structurally connecting clamping portion 106 and supporting portion 114. Stop portion 118 can include a generally-planar upper receiver stop face 120 that can face supporting portion 114 and can be perpendicular to the long axis 104 of elongate member 102. Upper receiver stop face 120 can be configured to prevent translation of upper receiver 500 toward the clamping portion 106 of the device 100 (that is, it can limit sliding of the upper receiver "down" (toward) the clamping portion and the vise in which the clamping portion would be clamped while in use) when a back side 502 of the upper receiver bears against upper receiver stop face 120. Stop portion 118 can also provide a barrier at the end of clamping portion 106 that is closest to supporting portion 114, effectively keeping jaws 406 of a vise 400 separated from upper receiver 500. This barrier may be a continuation of the curved sides of stop portion 118, which project out further than the clamping faces 108 of clamping portion 106, as illustrated in FIG. 3. Stop portion 118 can include curved sides generally concentric with the curved sides of supporting portion 114, but this is not necessary and other shapes for the stop portion are possible. Stop portion 114 can include one or more flat faces 119 to counter undesired rolling of firearm support device 100, when the device is placed alone, for example, on a flat surface.

Motion of upper receiver 500 in the opposite direction (that is, sliding "up" and away from clamping portion 102) can be constrained by lock knob 122 of firearm support device 100. Lock knob 122 can generally have the same shape as clamping portion 106, such that it includes parallel faces 128 on opposite sides of the lock knob and curved sides that align with the curved sides of the clamping portion, as illustrated in FIGS. 2-3. Further, lock knob 122 can include a boss 124 structured and configured to be received by any of a plurality of radially-aligned lock knob holes 126 defined by, and located circumferentially around, the cylindrical shaft 116 of supporting portion 114. Boss 124 and lock knob holes 126 may be cylindrical in shape, but this shape is not limiting, and other shapes are possible, such as pyramidal or cuboids. Lock knob holes 126 can be provided every 45 degrees about the circumference of cylindrical shaft 116, but this is not limiting, and any suitable angular distribution of holes is possible.

Lock knob holes 126 can be blind holes, as illustrated, or, in other embodiments, through holes. Lock knob holes 126 can be located at substantially identical distances from upper receiver stop face 120, such that when the back side 502 of the upper receiver 500 bears against the upper receiver stop face, and when boss 124 of lock knob 122 projects through the opening on the underside of the upper receiver (not visible in FIG. 5) and is received by one of the lock knob holes, the lock knob is positioned to prevent translation of the upper receiver away from the clamping portion of the device. In this position, a face 128 of lock knob 122 can be positioned to interfere with a takedown pin receptacle tab 504 of upper receiver 500, thereby preventing forward translation of the upper receiver relative to device 100. In FIG. 5, lock knob 122 is depicted before it is put into place to prevent translation of upper receiver 500, but aligned for such placement, as suggested by the dashed line between boss 124 and the receiver.

Figure 7:
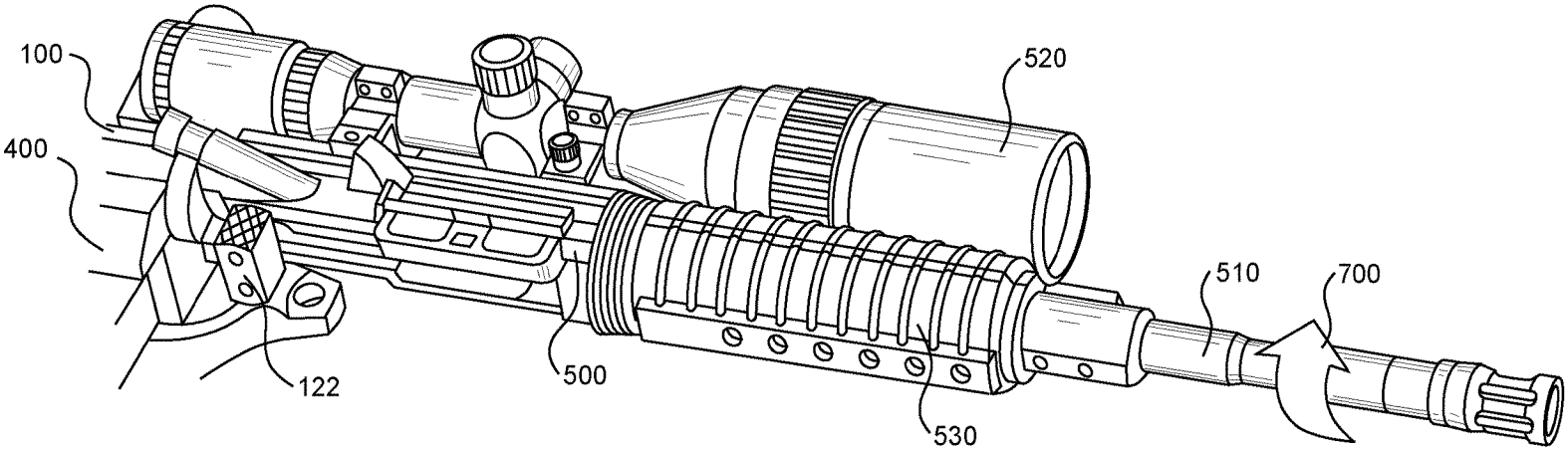
FIG. 7 is schematic perspective view of connected components of a rifle engaged with the firearm support device of FIG. 1, with the components rotated relative to the orientation of FIG. 5.

FIG. 7 is another schematic perspective illustration of connected components of a rifle engaged with firearm support device 100. The rifle components can include upper receiver 500, barrel 510, a sight 520, handguard 530, and other components not explicitly called-out. In FIG. 7, upper receiver 500 is illustrated as being rotated about 90 degrees (in the direction of arrow 700) relative to the position of the upper receiver shown in FIG. 5. The angular distribution of lock knob holes 126 about the cylindrical shaft 116 provide a variety of positions for placement of lock knob 122, thereby providing the ability to support components of the firearm at a variety of rotational positions, according to the preference of the user, which may depend on a maintenance task being performed.

Firearm support device 100 can be structured and configured to provide self-storage for its components. The end of clamping portion 106 can define or include a lock knob storage bore 134 (indicated in phantom lines in FIG. 2), which can be a blind hole, that is sized to securely receive boss 124 of lock knob 122. Boss 124 can include any suitable feature(s) to promote retention in lock knob storage bore 134 and/or lock knob holes 126, such as one or more o-rings 136 (as illustrated) and/or a detent mechanism (not illustrated). In some cases, lock knob storage bore 134, similar to lock knob holes 126, may be cylindrical in shape to correspond to the cylindrical shape of boss 124.

For storage of vise pins 112, lock knob 122 can define or include vise pin storage bores 138 (indicated in phantom lines in FIG. 2), which can be blind holes, that are sized to securely receive vise pins 112. Vise pins 112 can include any suitable feature(s) to promote retention in vise pin storage bores 138 and/or vise pin holes 110, such as one or more o-rings (not illustrated) and/or a detent mechanism 140 that enables a friction fit. As with vice pin holes 110, vise pin storage bores 138 may be elongate and cylindrical, similar to the shape and dimension of vise pins 112, and may have an internal circumference that is substantially equivalent to, albeit slightly larger than, the external circumference of vise pins, which can help to enable a friction fit.

Firearm support device 100 can be configured to provide robust support to firearm components when performing maintenance tasks that involve torque about the long axis 104 of the device and firearm components mounted thereto. Examples of such maintenance tasks include securing/removing a barrel to/from an upper receiver by torquing a barrel nut, which can involve large torques, and attaching/detaching barrel accessories such as flash suppressors. Compared with alternative support devices that can clamp an upper receiver externally and potentially subject the upper receive to damage from excessive forces, firearm support device 100 can support firearm components internally where some of the strongest components of the firearm are located.

Figure 6:
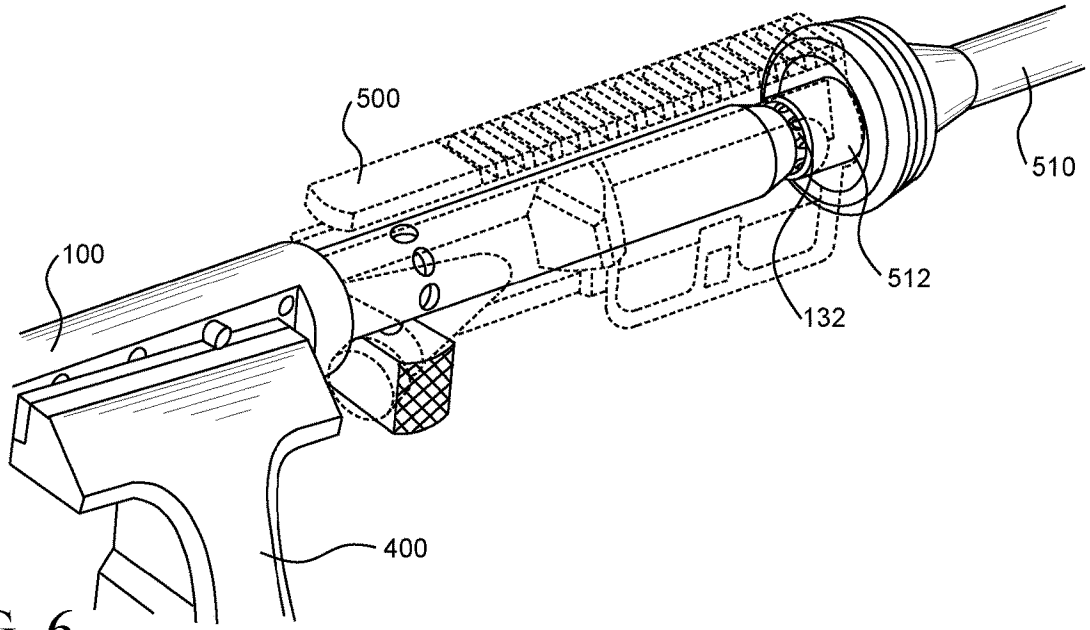
FIG. 6 is a schematic perspective view of the firearm support device of FIG. 1 clamped in a table vise, with an upper receiver and a barrel engaged with the device.

More specifically, supporting portion 114 of elongated portion 102 can include, at a barrel end 130 of the supporting portion, a plurality of splines 132 structured and configured to mate with lugs of a barrel extension (i.e., lugs of the "star chamber") of a barrel of the firearm. FIG. 6 is a schematic perspective illustration of firearm support device 100 clamped in a vise 400 and engaged with an upper receiver 500 (outlined in phantom) and a barrel 510 of a firearm. The barrel end 130 of supporting portion 114 is illustrated as protruding into a barrel extension 512 of barrel 510, with splines 132 being engaged with complementary interior lugs (not visible) of the barrel extension. Torques applied to barrel nuts and barrel accessories are balanced by reaction torques imparted to firearm components by firearm support device 100 via splines 132 at the star chamber lugs of the barrel extension 512.

As mentioned above, in addition to firearm support device 100, the firearm maintenance aid may include a firearm vise. Firearm vise 200, as illustrated in FIG. 8, may include vise jaws 202 that each have a plurality of jaw pin holes 204. Vise jaws 202 may be connected to each other by threaded rod 206 and may be comprised of first jaw 202*a* and second jaw 202*b*. Further, jaw pin holes 204 in one or both of vise jaws 202 may extend from outer surface 208 of the vise jaw through to inner surface 210 of the vise jaw. In some embodiments, some or all of jaw pin holes 204 in first jaw 202*a* can align with some or all of the jaw pin holes in second jaw 202*b*. Therefore, when a vise pin is inserted into vise jaws 202, it can insert into both first jaw 202*a* and second jaw 202*b* via the aligned jaw pin holes 204.

In some embodiments, vise jaws 202 may have relatively flat inner faces, and the flat inner faces may be textured to increase friction with a clamped component, such as firearm support device 100. However, a textured surface is not necessary for vise jaws 202 to securely clamp a component, as is described in detail below. Therefore, the inner face of each vise jaw 202 may, alternatively, be smooth. In some cases, inner faces 210 of vise jaws 202 may be parallel to each other and may be mirror images of each other such that when they are moved together so that the inner faces touch, the entire surface of one inner face touches the entire surface of another. However, in other embodiments, the inner faces may have slightly different dimensions and/or sizes such that one is smaller or larger than the other. In addition to inner faces, vise jaws 202 have top and side edges, which may be flat and angled 90 degrees from inner faces 210, as illustrated in FIGS. 8-12, as well as outer faces 208, which may be flat or decoratively patterned. Further, the outer face may be parallel to the inner faces or may slope outward from the top to the bottom, as illustrated in FIGS. 8-9.

As mentioned above, vise jaws 202 may not need a textured surface to securely clamp a component in place. To accomplish a secure clamp, vise jaws 202 may have a plurality of jaw pin holes 204 into which vise pins 112, 212 can be inserted to lock a clamping component, such as firearm support device 100 having vise pin holes 110, in place. Additionally, jaw pin holes 204 in vise jaws 202 may align with each other to enable a vise pin to pass from one vise jaw through to another. More specifically, jaw pin holes 204 may be located in both vise jaws 202*a/b* and aligned with each other such that one vise pin 212 can be simultaneously connected to a jaw pin hole in each vise jaw. In some embodiments, jaw pin holes 204 may pass from outer surface 208 to inner surface 210 of one or both vise jaws 202. For example, as illustrated in Figured 11 and 15, first vise jaw 202*a* may have jaw pin holes 204 that pass from outer surface 208 to inner surface 210 and second vise jaw 202*b* may have jaw pin holes that are only open to its inner surface. Therefore, when firearm support device 100 is clamped into firearm vise 200, vise pins 212 can be inserted from outer surface 208 of vise pin holes 204 of first vise jaw 202*a* and through to inner surface 210, through the support device, and into vise pin holes 204 on the inner surface of second vise jaw 202*b* where they can be stopped by the remaining solid material of the second vise jaw. While vise pin holes 204 are illustrated herein on outer surface 210 of first vise jaw 202*a*, it is noted that first vise jaw 202*b* can have vise pin holes 204 that penetrate from the outer surface through to the inner surface as well.

Figure 10:
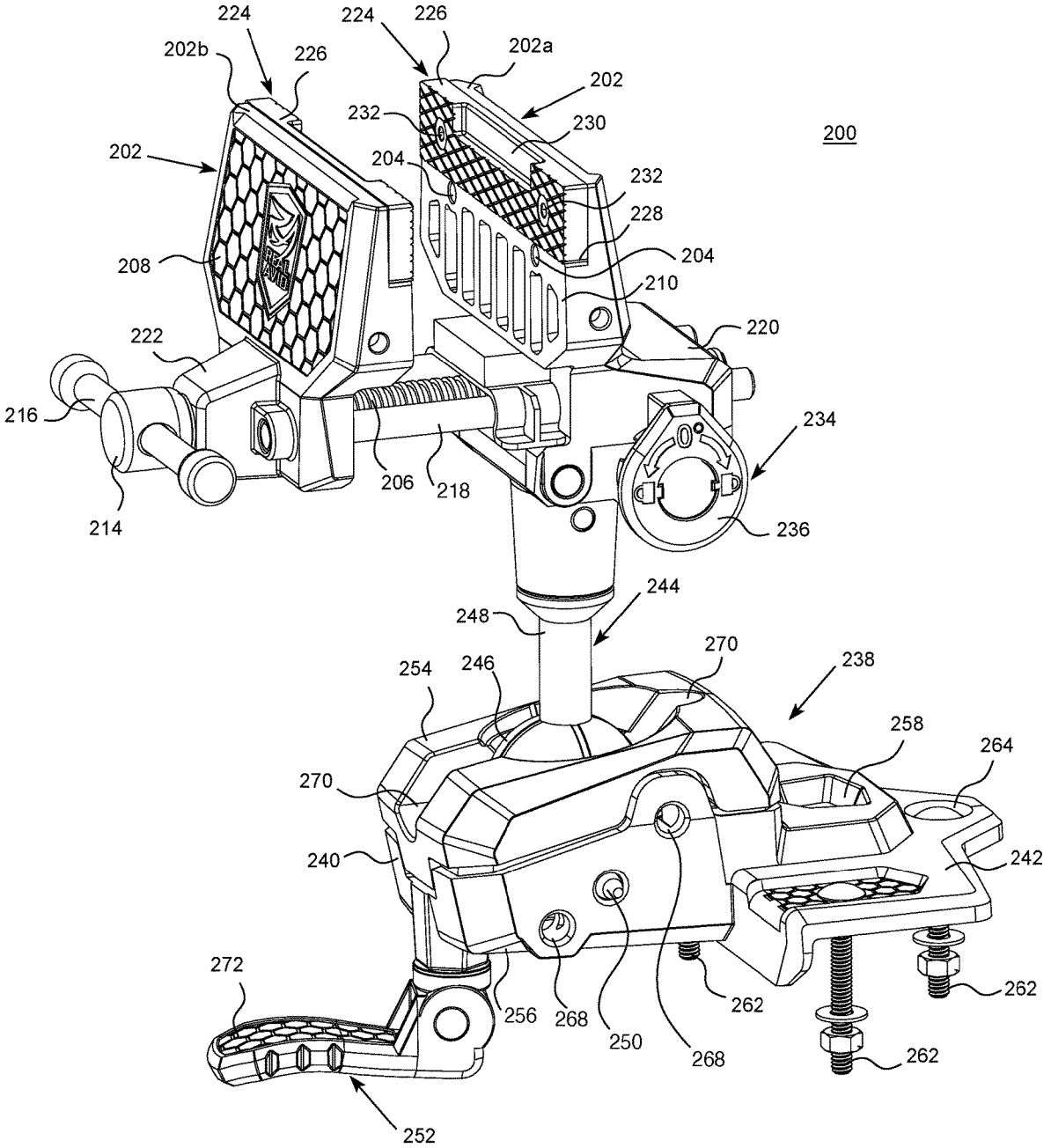
FIG. 10 is a schematic perspective view of an illustrative example of a firearm vise.
Figure 11:
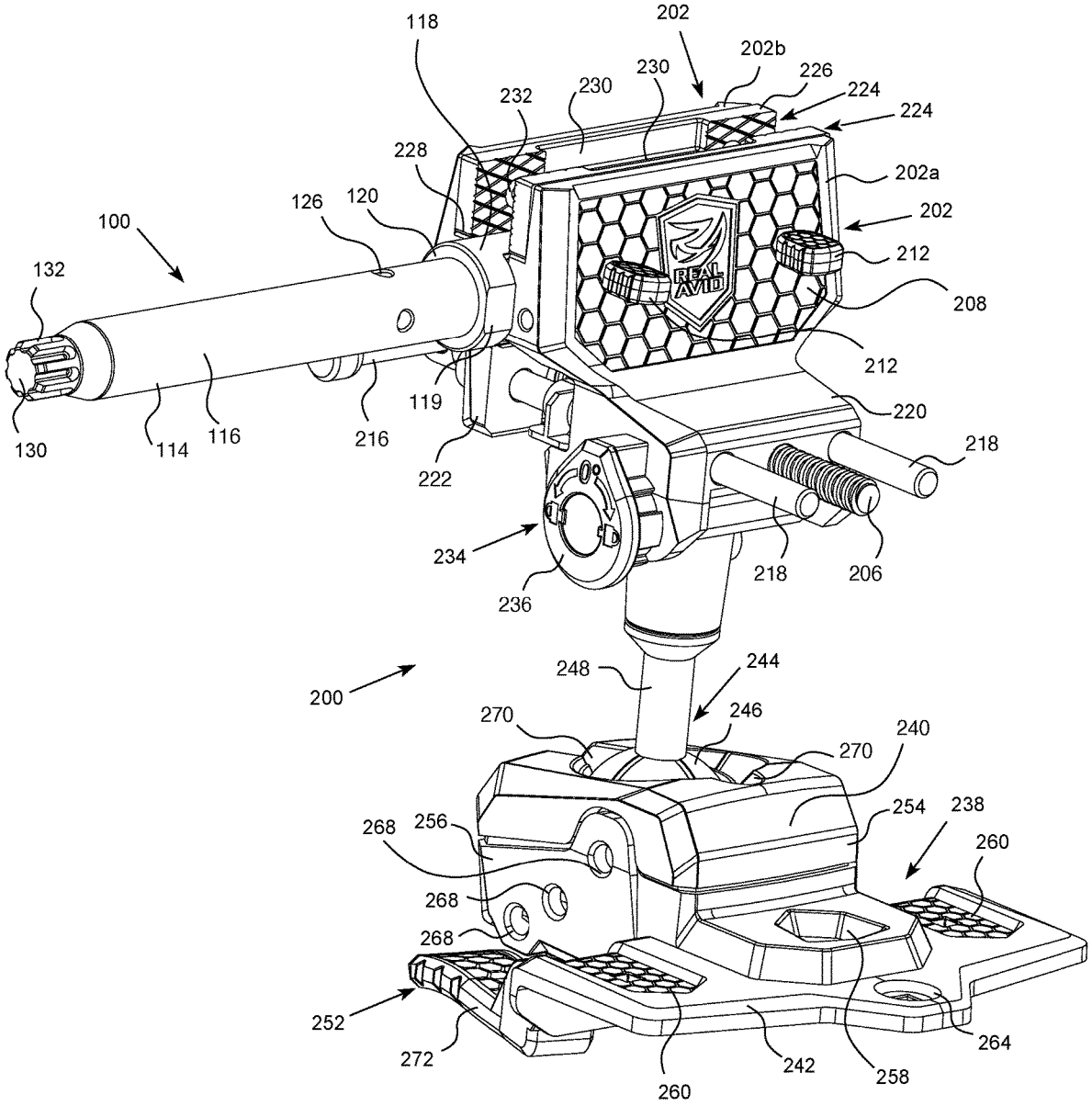
FIG. 11 is a schematic perspective view of the firearm support device of FIG. 1 clamped in the firearm vise of FIG. 10.
Figure 12:
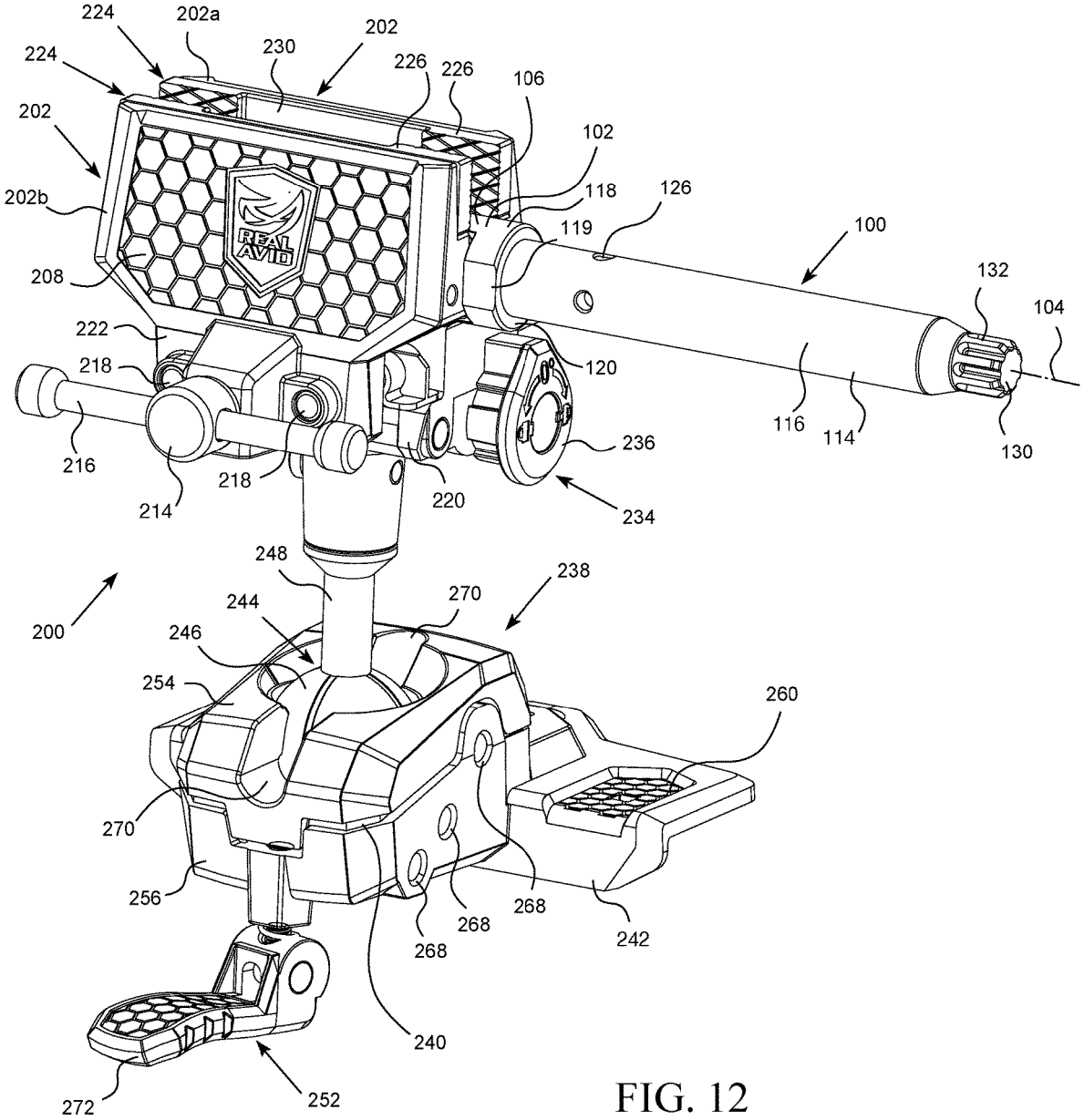
FIG. 12 is a schematic perspective view of the firearm support device of FIG. 1 clamped in the firearm vise of FIG. 10.

In some embodiments, jaw pin holes 204 may horizontally align with each other on each vise jaw 202. For example, as illustrated in FIGS. 10-11, two holes from vise jaw 202 may be aligned along a horizontal line such that they are the same distance from the top and/or bottom of first vise jaw 202*a*. This allows the component to be locked in a parallel configuration to inner faces 210 of vise jaws 202, as illustrated in FIGS. 11-12. Other jaw pin hole configurations may include two holes aligned along a vertical line such that when firearm vise 200 is upright, the first hole is directly above, or below, the second hole, and the component can be locked perpendicular, or 90 degrees, to inner faces 210. These are not the only alignments or configurations that may be possible. Further alignments or configurations can include any angle such as, but not limited to, jaw pin holes that allow for the component to be locked at a 30-degree angle, a 45-degree angle, and a 60-degree angle to the inner face. There may be several jaw pin holes in each vise jaw such that any or all of the above-mentioned hole configurations are accessible to a user. For example, in one embodiment, each vise jaw may have four vise pin holes, wherein two of the vise pin holes vertically align on one half of the vise jaw, two of the vise pin holes vertically align on another half of the vise jaw, the top two vise pin holes are horizontally aligned with each other, the bottom two vise pin holes are horizontally aligned with each other, and the bottom vise pin holes and their opposite side, top vise pin hole are in 45-degree alignment.

Figure 15:
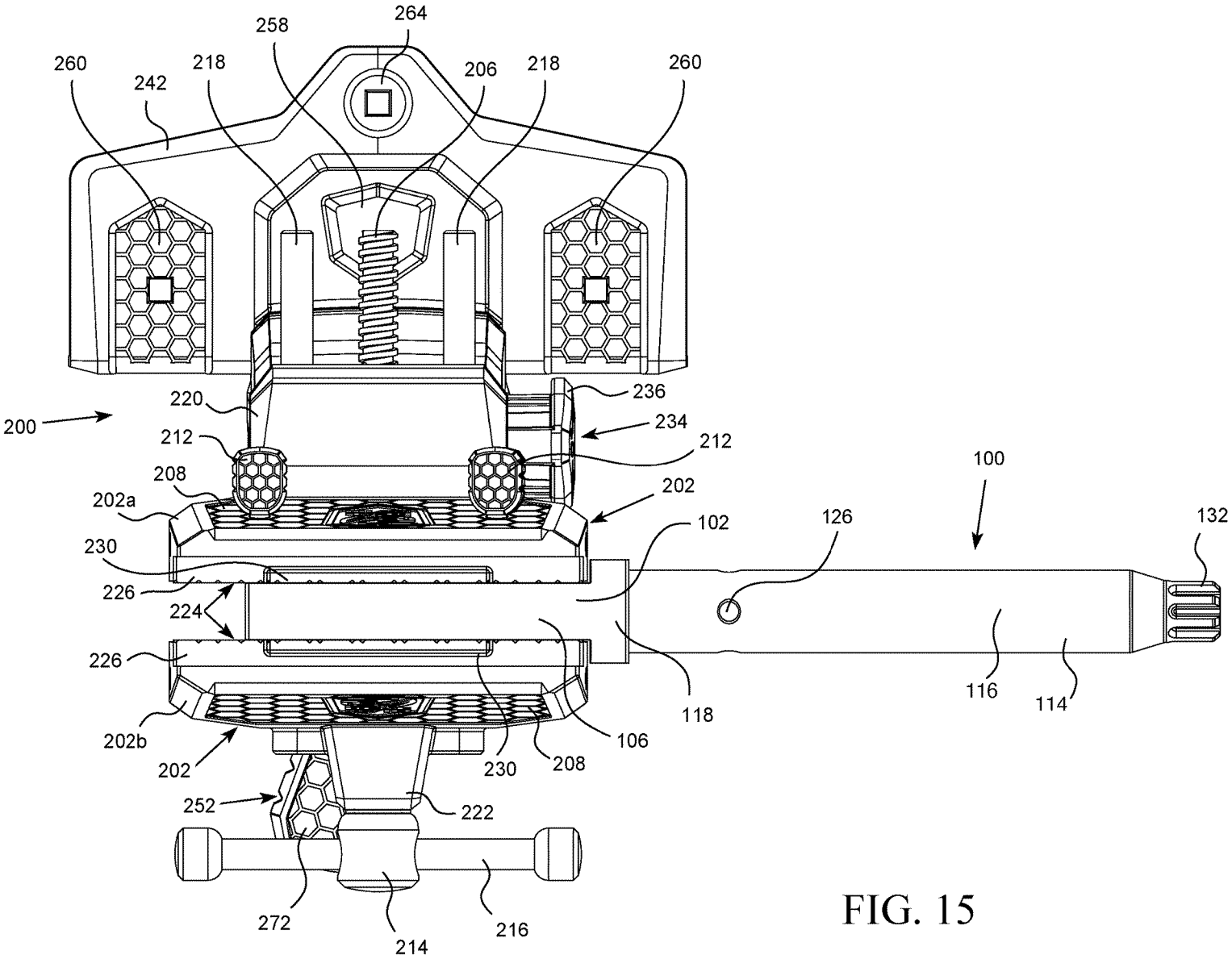
FIG. 15 is a schematic plan view of the firearm support device of FIG. 1 clamped in the firearm vise of FIG. 10.

Vise pins 112, 212 may be structured and configured to be received by any of the plurality of vise pin holes 110 of clamping portion 106, as described above, as well as by any of the plurality of jaw pin holes 204 of vise jaws 202, such that the vise pins are elongate and cylindrical in form and the vise pin holes are similarly shaped and dimensioned to enable a friction fit. More specifically, the external circumference of vise pins 112, 212 may be substantially equivalent, albeit slightly smaller, to the internal circumference of vise pin holes 110 and jaw pin holes 204. Vise pins 112, 212 may be inserted from the outer surface of vise jaw 202, thereby allowing user to clamp component between the vise jaws prior to inserting the vise pins. Further, as discussed more below, if the clamped component, such as firearm support device 100, has pin holes, the clamped component may first be secured between vise jaws 202 and then vise pin 112, 212 can be inserted into one vice jaw, through the clamped component, and into second jaw. If two or more vise pins 112, 212 are used, this can lock the clamped component securely in place for the user to work with. So positioned, the vise pins 112, 212 can serve to define and to assist in maintaining a working angle for the clamped component (for example, firearm support device 100). In some embodiments, vise pins 112 may be simple cylindrically shaped pins. Alternatively, vise pins 212 may have a head or grip on one end of a cylindrical shaped pin portion, as illustrated in FIGS. 11 and 15, to offer users a more ergonomic grip when placing the vise pin through vise jaws 202 and the clamped component. The head or grip may be textured or smooth and may have any ergonomic shape such as an elongated mushroom head, ball, or any other grab point.

To clamp vise jaws 202 on a clamping component, such as firearm support device 100, second jaw 202*b* may be moveable relative to first jaw 202*a*, such that the second jaw can move toward and away from the first jaw along threaded rod 206. More specifically, vise jaws 202 may further include bases 220, 222, and the bases may house threaded rod 206, allowing for inner faces 210 of the vise jaws to be free from interference of the threaded rod when clamping onto a component. For example, first jaw 202*a* may be connected to, or molded from the same part as, clamp base 220, and second jaw 202*b* may be connected to, or molded from the same part as, jaw base 222. Therefore, jaw base 222 may connect to clamp base 220 via threaded rod 206, enabling second jaw 202*b* to move relative to first jaw 202*a*. To enable rotation of threaded rod 206 and movement of one vise jaw toward another, the threaded rod may have a screw head attached on one end. For example, screw head 214 may be attached to threaded rod 206 on an outer portion of jaw base 222 of second jaw 202*b*, as illustrated in FIGS. 8-10.

Further, screw head 214 may have an aperture through which handle 216 is inserted. In some cases, screw head 214 and handle 216 may be one singular molded part and in other cases, they may be separate parts. Handle 216 can be elongated and rigid, such that it will not bend or flex when human pressure is applied to the handle. Additionally, handle 216 may be straight, as illustrated, or have curvature, which can provide an ergonomic grip to user. When handle 216 is turned, it can cause rotation of screw head 214, which can cause rotation of threaded rod 206. Rotation of threaded rod 206 can then cause second jaw 202*b* to move toward or away from first jaw 202*a*. For example, clockwise rotation of threaded rod 206 may cause second jaw 202*b* to move toward first jaw 202*a*, while counterclockwise rotation of the threaded rod may cause second jaw to move away from first jaw.

In addition to threaded rod 206, jaw base 222 may also be connected to clamp base 220 via one or more guide bars 218. Guide bars 218 may be smooth so as not to provide friction when second jaw 202*b* moves toward first jaw 202*a*. Further, guide bars 218 may be cylindrical, as illustrated in FIGS. 10-11, or may have another shape such as rectangular or pyramidal, and they may offer additional support for when heavy components are clamped between vise jaws 202. This additional support may keep vise jaws 202 from becoming misaligned if they are twisted due to torque applied during use of firearm vise 200, and the support may also prevent threaded rod 206 from bending due to having to withstand too much torque. In some embodiments, as illustrated in FIG. 9, firearm vise 200 may include two guide bars 218 that are parallel to, and on opposite sides of, threaded rod 206.

In some embodiments, vise jaws 202 may each have a ledged, upper recess on inner faces 210 such that the vise jaws are compatible with insert 224. Insert 224 may be approximately rectangular with flat inner and outer faces, which may be parallel to each other, may have top long edge 226 and bottom long edge 228, and the upper recess in vise jaws 202 may be approximately the same size and shape as the insert such that when the insert is attached to the vise jaw, the side and upper edges of both the vise jaw and the insert align and the inner faces are on the same plane. In some cases, the inner face of insert 224 may be textured (for example, knurled) and the outer face of the insert may be smooth, although this is not required and either or both faces may be textured or smooth. If the outer face of insert 224 is smooth, the surface of the ledged, upper recess may also be smooth to prevent gaps between the insert and the upper recess when they are connected together. Since insert 224 may be removable, an attachment mechanism can be used to keep the insert connected to vise jaw 202. More specifically, vise jaw 202 and insert 224 may be attached or connected using connections such as, but not limited to, screws 232, as illustrated in FIGS. 8 and 10, snap fit connections, or dove tail connections.

Insert 224 may have cutout or recess 230 along top long edge 226 or bottom long edge 228 that is roughly rectangular. In some embodiments, the cutout/recess is through the entire insert, thereby causing the insert to have a u-shape. In other embodiments, cutout/recess 230 is only a portion of a long edge such that the back of insert 224 remains a complete rectangle, as illustrated in FIGS. 8, 10, and 15. Further, insert 224 may be reversible and, if so, cutout/recess 230 along top long edge 226 may appear to be along a top portion when insert is in one configuration and it may appear to be along a bottom portion when insert is rotated 180 degrees into a reversed configuration.

In some embodiments, if jaw pin holes 204 are located in the region of vise jaws 202 where insert 224 attaches, then in order to retain the securing function of vise pins 112, 212 when the insert is attached to the vise jaw, the insert can have insert pin holes that align with jaw pin holes 204. More specifically, the insert pin holes may be positioned such that they align with jaw pin holes 204 regardless of whether insert 224 is upright or upside down. For example, the insert pin holes may be located in the center of the insert. In other embodiments, the insert may have a first set of holes that align with jaw pin holes 204 in a first configuration and a second set of holes of that align with the jaw pin holes when the insert is in the reversed configuration. However, to simplify the design of firearm vise 200, jaw pin holes 204 may be located beneath the connection region of insert 224 with vise jaws 202, as illustrated in FIG. 10.

In addition to connecting to first vise jaw 202*a*, clamp base 220 may also include, and be controlled by, leveling knob 234, which may also indirectly control jaw base 222 via its attachment to the clamp base vis-a-vis threaded rod 206. Leveling knob 234 may include a pin/rod (not shown), a spring (not shown), and knob 236 connected to an outer end of the pin/rod. The pin/rod may be locked within clamp base 220 when leveling knob 234 is in its home position. Then, when knob 236 is pulled out, the spring can be compressed, the pin/rod can be pulled out and removed from its home position, and leveling knob 234 may be able to rotate left or right. This left or right rotation can rotate vise jaws 202 a few degrees in one direction or another, which may help to level the vise jaws and the clamped component, such as firearm support device 100, for maintenance or other work. In some cases, when leveling knob 234 is rotated, the pin/rod is structured and configured such that it is prevented from locking back into its home position. However, leveling knob 234 may still provide enough friction and/or pressure to keep vise jaws 202 level until the user resets the leveling knob back into its home position.

In some embodiments, firearm vise 200 may include vise base 238, which can connect to vise jaws 202 via clamp base 220, as illustrated in FIGS. 10-12. Vise base 238 may be used to mount firearm vise 200 to a flat surface such as a workbench or table and may include housing 240, table mount 242, and a table clamp (not shown). Connection of vise base 238 to clamp base 220 may be via ball joint 244, which can include ball 246, stem 248, ball lock 250, and/or cam latch 252, as illustrated in FIG. 10. Alternatively, connection of vise base 238 to clamp base 220 can also take place by a fixed connection component such as, but not limited to, a rod, neck, or post. Connection by ball joint 244 may allow for fewer jaw pin holes 204 since vise jaws 202 can move the clamped component, such as firearm support device 100, into many positions, angles, and configurations due to the flexibility of the ball joint, whereas connection by a fixed connection component may be more compatible with embodiments of the vise jaws that include additional jaw pin holes since the additional jaw pin holes will enable the clamped component to be moved into more than one secured position.

Housing 240 of vise base 238 may be comprised of one or more parts. In embodiments having ball joint 244 as a connection mechanism between vise base 238 and clamp base 220, housing 240 can have at least two parts, such as top portion 254 and bottom portion 256, to aid in assembly and, as mentioned in more detail below, locking of the ball joint via a clamping mechanism. In embodiments having a fixed connection component, the housing may be limited to one piece. Housing 240 may be either connected to table mount 242 or may be a continuous piece with the table mount such that they are not removable from each other. In some cases, housing 240 may have a top portion separate from a bottom portion and the bottom portion may be one continuous piece with table mount 242. Other configurations are possible.

As mentioned above, table mount 242 and the table clamp (not shown) can secure firearm vise 200 to a flat, working surface such as a workbench or table. Therefore, table mount 242 may have a flat bottom face to increase the amount of surface area in contact with the working surface and to allow for a secure mount to the working surface. The top of table mount 242 may also be flat or may have additional features. For example, the top of table mount 242 may include storage trays, cavities, or pockets 258 for holding tools or firearm parts. In some embodiments, the top of table mount may include recessed portion 260 that is structured and configured to receive a portion of table clamp. Further, housing 240 may connect to table mount 242 along a central portion such that the table mount may have recessed portion 260 on either side of the central portion, as illustrated in FIGS. 11 and 15. This allows for two table clamps to secure table mount 242 to the working surface. More specifically, the table clamp may be a c-clamp and a top arm of the table clamp may nest into recessed portion 260 on table mount 242. This recessed portion may be smooth, or it may have a texture so as to increase friction and prevent unwanted sliding between table mount 242 and a table clamp. Another method for connecting table mount 242 to a work surface is via screws, as illustrated in FIG. 10. More specifically, recessed portion(s) 260 may include holes or openings into which screws 262 can be inserted. Further, table mount 242 may have connection point 264 specifically structured and configured for screw 262, as further illustrated in FIG. 10, wherein the connection point is a recessed portion that is smaller than recessed portion 260 and shaped more similarly to a screw head.

Figure 13A:
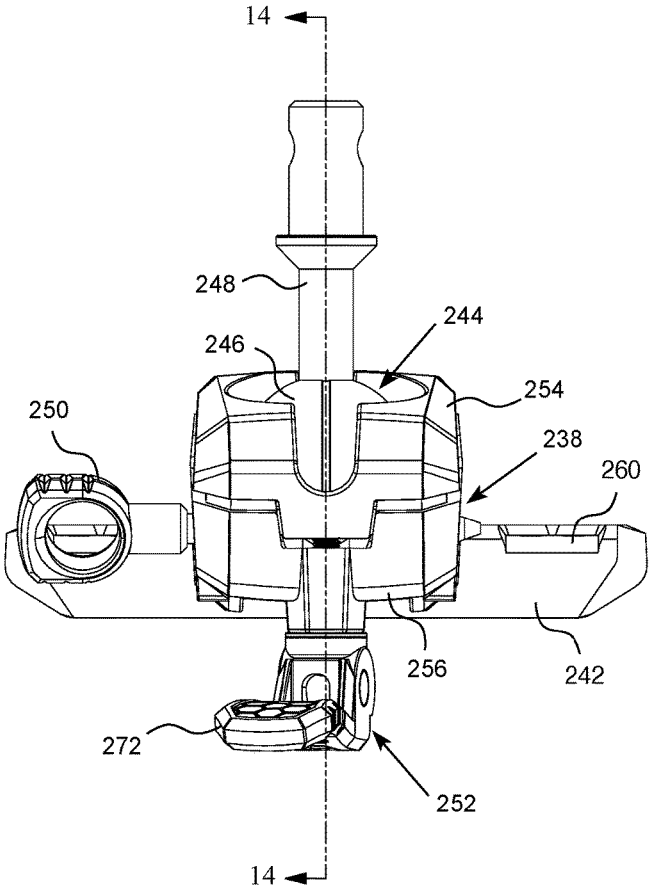
FIG. 13*a* is a schematic front view of a portion of the firearm vise of FIG. 8.
Figure 13B:
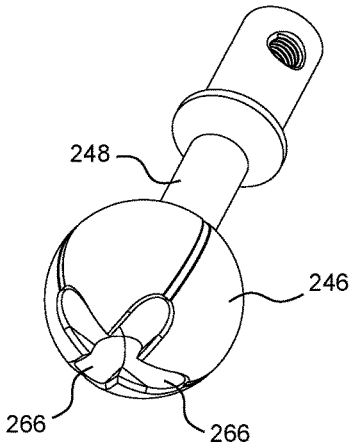
FIG. 13*b* is a schematic perspective view of a portion of a ball joint of the firearm vise of FIG. 8.
Figure 14:
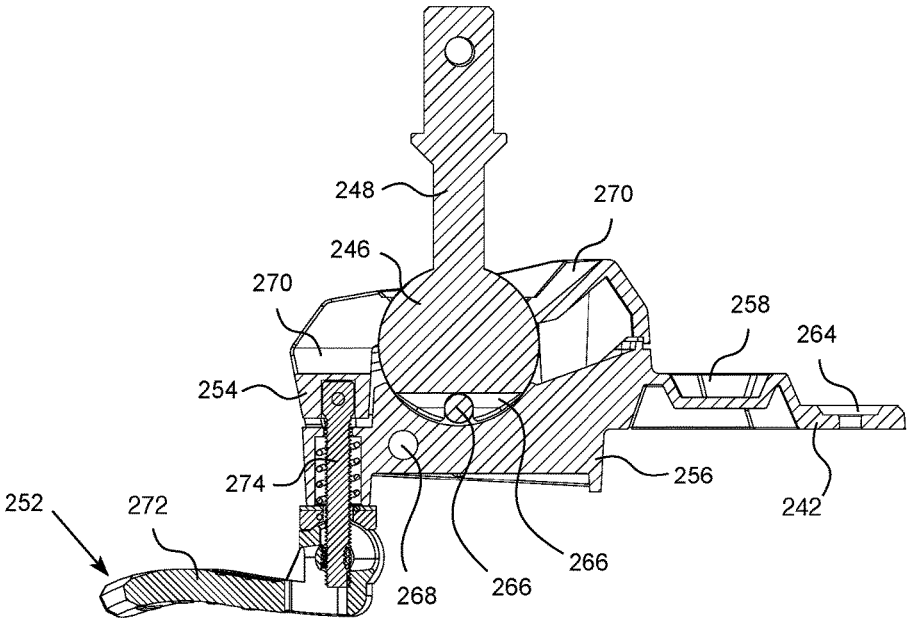
FIG. 14 is a schematic cross-sectional side view of the portion of the firearm vise of FIG. 13*a* taken from the line 14-14 in FIG. 13*a*.

As mentioned above, housing 240, in addition to connecting to table mount 242, can connect to a connection component, such as ball joint 244, to connect vise base 238 to clamp base 220. As illustrated in FIGS. 10 and 13*a*, ball joint 244 may include ball 246, stem 248, and ball lock 250, wherein the stem can be connected on a first end to the ball and on a second end to clamp base 220, and the ball lock can secure the ball in one or more predetermined positions. Ball 246 may be located at least partially within housing 240 or, alternatively, may be completely surrounded by the housing. In some embodiments, ball 246 may be comprised of one or more passages 266 into which ball lock 250 can be inserted in order to lock the ball in a predetermined position. More specifically, ball 246 can include two passages 266 that may be located along a bottom of ball joint, may be perpendicular to each other, and may cross through each other, as illustrated in FIG. 13*b*. Passages 266 may not run completely through ball 246, but may be open such that ball lock 250, when inserted into a passage, is not surrounded by the ball but is wedged between the ball and an interior of housing. Housing 240 may, therefore, include a plurality of ball lock holes 268 into which ball lock 250 can be inserted. As illustrated in FIGS. 10-12 and 13*b*, one embodiment may include three ball lock holes 268 in housing 240 and two perpendicular passages in ball 246, enabling ball lock 250 to secure ball joint 244 in one of eight positions: facing forward and vertical, left and vertical, right and vertical, or back and vertical when the ball lock is inserted through, for example, a middle ball lock hole, and facing forward and horizontal, left and horizontal, right and horizontal, or back and horizontal when the ball lock is inserted through a back ball lock hole. The third ball lock hole (for example, the hole closest to cam latch 252 in FIG. 10), may be used as a storage hole when ball lock 250 is not in use. The top of housing may include recessed passages 270 near its front and back to accommodate stem 248 of ball joint 244 when the ball joint is in a horizontally forward or backward position, respectively.

In addition to ball lock 250, which can be used to lock ball 246 securely in place when high amounts of torque may be applied to vise jaws 202, the ball joint may include cam latch 252 for securing the ball within housing 240 in additional positions that are not compatible with ball lock holes 268 and the ball lock. Cam latch 252 may help connect top and bottom of housing 254, 256 and can be used to lock ball 246 in any position by compressing the top and bottom of the housing onto the ball. More specifically, cam latch 252 can include lever 272 and threaded rod 274, and top and bottom of housing 254, 256 can have a threaded receiving cavity for receiving the threaded rod. To secure ball 246 in housing 244, lever 272 can be twisted (for example, counterclockwise), thereby turning threaded rod 274 within the threaded receiving cavity and pulling top and bottom of housing 254, 256 toward each other and tightening housing 240 around the ball. Lever 272 of cam latch 252 can then be rotated 90 degrees to lock in place, which prevents countertwisting of threaded rod 274 and adds additional compression to ball 246. To loosen ball 246, lever 272 can be straightened, rotated in the opposite direction (for example, clockwise), thereby turning threaded rod 274 within the threaded receiving cavity in the opposite direction and allowing top and bottom of housing 254, 256 to separate from each other and from the ball.

In practice, firearm support device 100 and firearm vise 200 can be used together to securely position a firearm in place when maintenance or assembly of the firearm is needed. For example, to assemble the firearm maintenance aid for use with a firearm, a user can place firearm support device 100 between two vise jaws 202 of firearm vise 200. Firearm support device 100 can have clamping portion 104, which can include two parallel clamping faces 108 on opposite sides of the clamping portion and which can define a plurality of vise pin holes 110. Vise jaws 202 can be comprised of first jaw 202*a* and second jaw 202*b*, and the first and second jaws can each define a plurality of jaw pin holes 204, wherein the jaw pin holes can extend between outer surface 208 of one or both jaws and inner surface 210 of each jaw. Once placed between vise jaws 202, the user can align at least two of the plurality of vise pin holes 110 with at least two of the plurality of jaw pin holes 204 from each jaw 202 and can clamp firearm support device 100 between the first and second jaws 202*a/b* of firearm vise 200, thereby implementing a first locking feature. To further secure firearm support device 100 within firearm vise 200, the user can next insert a vise pin 212 into outer surface 208 and through to inner surface 210 of one of jaw pin holes 204 of, for example, first vise jaw 202*a* and continue inserting the vise pin until it penetrates through one of vise pin holes 110 of elongate member 102 of support device 100 and into the inner surface of one of the jaw pin holes of, for example, second vise jaw 202*b*. In this manner, a second locking feature is in place, and firearm support device 100 is no longer separable from firearm vise 200 using solely shear forces.

To further lock firearm support device 100 into a specific configuration, the user can insert a second vise pin 212 into outer surface 208 and through to inner surface 210 of a second of the jaw pin holes 204 of, for example, first vise jaw 202*a* and continue inserting the vise pin until it penetrates through a second of vise pin holes 110 of elongate member 102 and into the inner surface of a second of the jaw pin holes of, for example, second vise jaw 202*b*. Once this third locking feature is in place, firearm support device 100 is not only prevented from separating from firearm vise 200, but it is now locked in a specific configuration that will resist user-applied torque in any direction. Therefore, a user can now insert barrel end 130 of supporting portion 114 of firearm support device 100 into an upper receiver of a firearm and can actively work on the firearm with reassurance that firearm vise 200 will prevent unwanted movement of firearm support device 100 when it is secured in the vise.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A firearm maintenance aid, comprising:

a firearm vise having first and second jaws, a threaded rod connecting first and second jaws, and at least two jaw pin holes in each jaw, wherein each of the at least two jaw pin holes in the first jaw align with each of the at least two jaw pin holes in the second jaw, and wherein the at least two jaw pin holes of at least one of the first or second jaw extend from an outer surface through to an inner surface of the at least one of the first or second jaw;

a firearm support device having an elongate member, the elongate member including a clamping portion structured and configured to be clamped between the first and second jaws of the firearm vise, the clamping portion including two parallel clamping faces on opposite sides of the clamping portion, the clamping portion defining a plurality of vise pin holes, and a supporting portion opposite the clamping portion, the supporting portion including a generally cylindrical shaft, wherein the at least two jaw pin holes in each jaw align with at least two of the plurality of vise pin holes; and at least two vise pins, wherein the at least two vise pins are configured to connect the first jaw, the elongate member, and the second jaw together by concurrently penetrating through the aligned at least two jaw pin holes of the first jaw, at least two vise pin holes of the clamping portion, and at least two jaw pin holes of the second jaw.

2. The firearm maintenance aid of claim 1, wherein the at least two vise pins are structured and configured to be received by any of the plurality of vise pin holes of the clamping portion.

3. The firearm maintenance aid of claim 1, wherein the at least two vise pins are structured and configured to be received by any of the at least two jaw pin holes of the first and second jaws.

4. The firearm maintenance aid of claim 1, the firearm support device further comprising a stop portion located between and structurally connecting the clamping portion and the supporting portion, the stop portion including a generally-planar upper receiver stop face that faces the supporting portion and is perpendicular to a long axis of the elongate member.

5. The firearm maintenance aid of claim 4, wherein the supporting portion is structured and configured to provide support to an upper receiver of a firearm, and the upper receiver stop face is configured to prevent translation of the upper receiver toward the clamping portion of the device when a back side of the upper receiver bears against the upper receiver stop face.

6. The firearm maintenance aid of claim 5, the firearm support device further comprising a lock knob having a boss, wherein the supporting portion defines a plurality of lock knob holes structured and configured to receive the boss, the lock knob holes being aligned radially and located circumferentially around the generally cylindrical shaft, and the lock knob holes being located at substantially identical distances from the upper receiver stop face, such that when the back side of the upper receiver bears against the upper receiver stop face, and when the boss of the lock knob projects through an opening on an underside of the upper receiver and is received by one of the lock knob holes, the lock knob is positioned to prevent translation of the upper receiver away from the clamping portion of the device.

7. The firearm maintenance aid of claim 1, the firearm support device further comprising a lock knob, the lock knob including a boss structured and configured to be received by any of a plurality of lock knob holes located around the shaft of the supporting portion, wherein the supporting portion of the elongate member includes a barrel end and is structured and configured to provide support to an upper receiver of a firearm, the supporting portion further defines the plurality of lock knob holes aligned radially and located circumferentially around the generally cylindrical shaft, and the lock knob holes are located at substantially identical distances from the barrel end of the supporting portion, such that when the boss of the lock knob projects through an opening on an underside of the upper receiver and is received by one of the lock knob holes, the lock knob is positioned to prevent translation of the upper receiver toward the barrel end of the device.

8. The firearm maintenance aid of claim 7, the firearm support device further comprising a stop portion located between and structurally connecting the clamping portion and the supporting portion, the stop portion including a generally-planar upper receiver stop face that faces the supporting portion and is perpendicular to a long axis of the elongate member, the upper receiver stop face configured to prevent translation of the upper receiver toward the clamping portion of the device when a back side of the upper receiver bears against the upper receiver stop face.

9. The firearm maintenance aid of claim 1, wherein the clamping portion is located at a first end of the elongate member, the supporting portion is located at a second end of the elongate member, and the supporting portion of the firearm support device is aligned with a long axis of the elongate member.

10. The firearm maintenance aid of claim 1, wherein the supporting portion further includes, at a barrel end of the supporting portion, a plurality of splines structured and configured to mate with lugs of a barrel extension of a barrel of the firearm.

11. A method of assembling a firearm maintenance aid, the method comprising:

placing a firearm support device having a clamping portion between first and second jaws of a firearm vise, the clamping portion including two parallel clamping faces on opposite sides of the clamping portion and defining a plurality of vise pin holes, and the first and second jaws each defining a plurality of jaw pin holes, wherein the jaw pin holes extend from an outer surface of at least one of the first or second jaws through to an inner surface of the at least one of the first or second jaws;

aligning at least two of the plurality of vise pin holes with at least two of the plurality of jaw pin holes from each jaw;

clamping the firearm support device between the first and second jaws of the firearm vise;

inserting a vise pin into one of the jaw pin holes of the at least one of the first or second jaws having the jaw pin holes extend from the outer surface through to the inner surface;

inserting the vise pin through one of the vise pin holes of the elongate member; and inserting the vise pin into the inner surface of one of the jaw pin holes of the other of the first or second jaws.

12. The method of claim 11, further comprising:

inserting a second vise pin into a second of the jaw pin holes of the at least one of the first or second jaws having the jaw pin holes extend from the outer surface through to the inner surface;

inserting the second vise pin through a second of the vise pin holes of the elongate member; and inserting the second vise pin into the inner surface of a second of the jaw pin holes of the other of the first or second jaws.

13. The method of claim 11, further comprising:

inserting a barrel end of a supporting portion of the firearm support device into an upper receiver of a firearm, wherein an elongate member is comprised of the clamping portion and the supporting portion, the supporting portion includes a generally cylindrical shaft and is located opposite the clamping portion, a stop portion is located between and structurally connects the clamping portion and the supporting portion, the stop portion includes a generally-planar upper receiver stop face that is perpendicular to a long axis of the elongate member, and the upper receiver stop face is configured to prevent translation of the upper receiver toward the clamping portion when a back side of the upper receiver bears against the upper receiver stop face.

14. A firearm maintenance aid, comprising:

a firearm vise having a first jaw, a second jaw moveable relative to the first jaw, a threaded rod connecting the first jaw and the second jaw, wherein the second jaw is moveable along the threaded rod toward and away from the first jaw, and a plurality of j aw pin holes in each of the first and second jaws, wherein at least two of the plurality of j aw pin holes in the first jaw align with at least two of the plurality of jaw pin holes in the second jaw, and wherein the jaw pin holes extending from an outer surface of at least one jaw through to an inner surface of the at least one jaw;

a firearm support device having a clamping portion structured and configured to be clamped between the first and second jaws of the firearm vise, the clamping portion including two parallel clamping faces on opposite sides of the clamping portion, and the clamping portion defining a plurality of vise pin holes, wherein the aligned, at least two jaw pin holes in each jaw further align with at least two of the plurality of vise pin holes; and at least two vise pins connecting the first jaw, the elongate member, and the second jaw together, wherein each of the at least two vise pins penetrate through one of the at least two jaw pin holes from the outer surface to the inner surface, through one of the at least two vise pin holes, and into one of the at least two jaw pin holes of the inner surface of the other of the first or second jaw.

15. The firearm maintenance aid of claim 14, the firearm vise further comprising a handle connected to a screw head on one end of the threaded rod, a plurality of guide bars parallel to, and on opposite sides of, the threaded rod, the plurality of guide bars connecting to the first and second jaws.

16. The firearm maintenance aid of claim 14, the firearm vise further comprising a clamp base attached to the first jaw and a jaw base attached to the second jaw, wherein the clamp base and the jaw base each include a threaded cavity for receiving the threaded rod.

17. The firearm maintenance aid of claim 16, the firearm vise further comprising a vise base having a housing and connected to the clamp base via a ball joint, wherein the ball joint includes a ball located within the housing, a stem connected on a first end to the ball and on a second end to the clamp base, and a ball locking mechanism for securing the ball in a predetermined position within the housing.

18. The firearm maintenance aid of claim 17, wherein the vise base further includes a cam latch for securing the ball in a second predetermined position.

19. The firearm maintenance aid of claim 16, the firearm vise further comprising a vise base having a table mount for securing the firearm vise to a flat surface.

20. The firearm maintenance aid of claim 14, the firearm vise further comprising a reversible jaw insert for at least one of the first and second jaws, the reversible jaw insert including top and bottom long edges, wherein the reversible jaw insert includes a recess along either or both of the top and bottom long edges, and the reversible jaw insert attaches to the inner surface of at least one of the first or second jaws.

* * * * *